US006603253B2

(12) United States Patent
Hasegawa et al.

(10) Patent No.: US 6,603,253 B2
(45) Date of Patent: Aug. 5, 2003

(54) COLOR CATHODE RAY TUBE WITH WIRE HAVING FOLDED PORTION

(75) Inventors: Takahiro Hasegawa, Gyoda (JP); Masashi Takeshima, Ibo-gun (JP); Hiroyuki Oda, Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 280 days.

(21) Appl. No.: 09/837,453

(22) Filed: Apr. 19, 2001

(65) Prior Publication Data

US 2001/0033132 A1 Oct. 25, 2001

(30) Foreign Application Priority Data

Apr. 20, 2000 (JP) ..... 2000-119808

(51) Int. Cl.[7] ..... H01J 29/82
(52) U.S. Cl. ..... 313/482; 313/417
(58) Field of Search ..... 313/417, 446, 313/451, 456, 457, 482, 477 HC, 285, 292

(56) References Cited

U.S. PATENT DOCUMENTS 4,061,943 A * 12/1977 DiDominico et al. ..... 313/482
4,720,654 A * 1/1988 Hernqvist et al. ..... 313/417
5,001,389 A * 3/1991 Herngvist ..... 313/417
5,140,218 A * 8/1992 Van Eck ..... 313/417
5,479,067 A * 12/1995 Van Der Wilk et al. .... 313/417

FOREIGN PATENT DOCUMENTS

JP 1-62638 4/1989
JP 4-230936 8/1992

* cited by examiner

*Primary Examiner*—Michael H. Day
(74) *Attorney, Agent, or Firm*—Oblon, Spivak, McClelland, Maier & Neustadt, P.C.

(57) ABSTRACT

In a color cathode ray tube, an electron gun assembly is received in a neck and includes three cathode electrodes, which are heated by heaters, respectively, and a plurality of electrodes. A sealing portion is welded to a stem section of the neck, and stem pins holding the electron gun are buried in the sealing portion. A wire is connected at one end to the stem pin and also connected at the other end to the electrode corresponding to the stem pin so as to electrically connect the electrode to the stem pin. The wire is provided with a folded portion. Even if the wire is thermally expanded, the thermal expansion is absorbed by the folded portion so as to suppress the fluctuation of the cathode current flowing into the electrode.

8 Claims, 5 Drawing Sheets

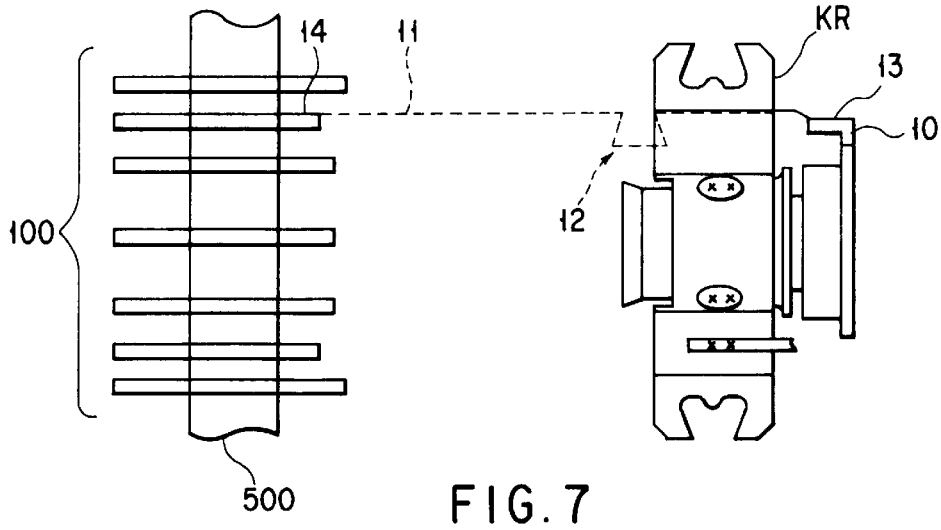
FIG. 7
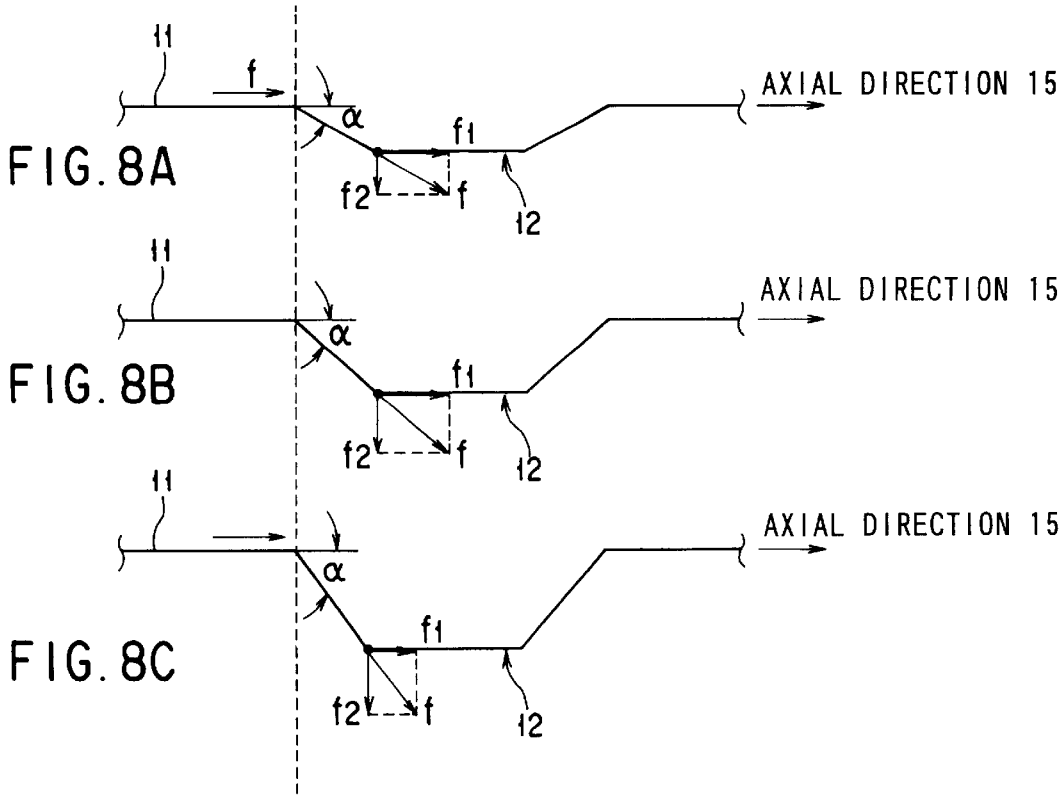
FIG. 8A
FIG. 8B
FIG. 8C

COLOR CATHODE RAY TUBE WITH WIRE HAVING FOLDED PORTION

CROSS-REFERENCE TO RELATED APPLICATIONS

This application is based upon and claims the benefit of priority from the prior Japanese Patent Application No. 2000-119808, filed Apr. 20, 2000, the entire contents of which are incorporated herein by reference.

BACKGROUND OF THE INVENTION

The present invention relates to a color cathode ray tube, particularly, to a color cathode ray tube capable of suppressing the fluctuation in the cathode current brought about by the thermal expansion taking place in the members constituting the electron gun assembly.

In general, a color cathode ray tube comprises an envelope including a panel having a phosphor screen formed therein, and a funnel integrally bonded to the panel and including a neck. An electron gun assembly is received in the neck of the funnel.

A so-called "in-line-type" electron gun assembly, in which three electron guns are arranged in a line, is mainly used nowadays as the electron gun assembly of a color cathode ray tube. The in-line-type electron gun assembly comprises in general a beam generating section called triode, which includes a cathode electrode, a first electrode, and a second electrode, and a main lens section for focusing the three electron beams on a phosphor screen. The electron gun assembly is received in the neck of cylindrical structure having a diameter of about 20 to 40 mm, and a stem section in the shape of a circular glass is welded to the neck. Stem pins made of a conductive metal are buried in the stem section such that the electron gun assembly within the tube is connected to the circuit outside the tube via the stem pins, and the electron gun assembly within the tube is held by the stem pins in the stem section so as to be fixed within the tube.

In the triode section referred to above, voltage of hundred and scores of V is applied from outside the tube to the cathode electrode through the stem pins. Also, 0 V and hundreds of V are applied to the first and second electrodes, respectively, from outside the tube through the stem pins. The cathode electrode is provided with a heater for generating electrons from the cathode electrode. By heating the cathode electrode by the heater, an electron beam is emitted from the cathode electrode. The electron beam emitted from the cathode electrode passes through the beam-passing apertures of the first and second electrodes so as to be guided to the main lens section and, then, finally focused by the main lens section on the phosphor screen.

The main lens section is formed of at least two electrodes including a final accelerating electrode connected to an anode to which is applied a high voltage of about 25 to 30 kV through an inner conductive film coated on the inner surface of the neck section, and a focus electrode to which is applied a voltage about 20 to 40% of the anode high voltage through the stem pins.

In general, the final accelerating electrode and the focus electrode are arranged to face each other such that the beam-passing holes of these two electrodes are positioned apart from each other by about 1 mm. Applying a potential difference between these mutually facing two electrodes forms the main lens section, and the electron beam is focused on the phosphor screen by the main lens thus formed.

Each of these electrodes is fixed to and supported by an insulating supporting bar made of, for example, a glass. To be more specific, the strap mounted to each electrode is buried in the insulating supporting bar so as to have each electrode fixed and supported.

As described above, a heater mounted inside the cathode electrode heats the cathode electrode. Originally, the heater is intended to heat the cathode electrode alone. However, each of the electrodes of the electrode gun assembly including the cathode electrode and the heater is fixed to and supported by an insulating supporting bar made of, for example, a glass. As a result, the heat generated from the heater is transmitted to not only the cathode electrode but also to the other electrodes of the electron gun assembly by the heat conduction via the insulating supporting bar. These electrodes are also heated by the heat radiated directly from the cathode electrode itself so as to lead to the temperature elevation.

The temperature elevation caused by the heat of the heater is most prominent in the first electrode positioned closest to the cathode electrode. Then, the temperature elevation is gradually lowered in the second electrode, the third electrode, et seq. as the distance from the cathode electrode is increased.

What is serious is the temperature elevation of the first and second electrodes serving to control the generation limit (cutoff) of the electron beam from the cathode electrode. If the temperature of these electrodes is elevated, these electrodes are thermally expanded so as to change the distance between these electrodes and, thus, to change the cutoff. As a result, the cathode electrode current is changed with increase in the temperature elevation of the electrodes.

It should be noted that the first electrode and the second electrode are formed of relatively thin plates in many cases. Therefore, if the first electrode and the second electrode are thermally expanded and deformed, the distance between these first and second electrodes is changed so as to change the cutoff. As a result, the cathode electrode current is changed in accordance with elevation of the electrode temperature.

It is possible for the problem described above to take place also in the third electrode the electric field of which somewhat affects the cathode electrode. However, the effect of the electric field given from the third electrode to the cathode electrode is markedly smaller than that given from any of the first and second electrodes to the cathode electrode. In addition, the temperature elevation of the third electrode is small because the third electrode is positioned remote from the cathode electrode. It follows that the particular problem is substantially negligible when it comes to the third electrode.

It may be possible to overcome the above-noted problem by using materials low in thermal expansion coefficient for forming the first electrode, the second electrode, etc. However, it is impossible to suppress the thermal expansion to zero and, thus, it is necessary to design the first electrode and the second electrode based on a subtle combination of the thermal expansion coefficients.

It should also be noted that a wire made of a conductive material is welded to each electrode for the electrical connection to the circuit outside the tube. When it comes to the thin plate-like electrodes such as the first electrode and the second electrode, the electrode is provided with a welding margin to which one end of the wire for the electrical connection to the circuit outside the tube is welded, and the other end of the wire is welded to the stem pin.

Naturally, the wire welded to the electrode is also heated by the heat of the heater so as to be thermally expanded. What should be noted is that, since the wire is welded to a part of the electrode, the thermally expanded wire pushes the welded part of the electrode, giving rise to a problem that the distance between the adjacent electrodes is changed in the vicinity of only that portion of the electrode to which the wire was welded. It follows that, even if the materials of the first electrode and the second electrode are selected exquisitely, the first electrode or the second electrode is locally deformed.

The local deformation brings about a change in the cathode electrode current in only one of the three cathode electrodes arranged in-line so as to disturb the current balance of the three electron beams in accordance with temperature elevation of the wire. As a result, the color of the image displayed on the phosphor screen is prominently changed.

In order to overcome the problem, it is necessary to improve the supporting strength of the electrodes of each electron gun assembly, to improve the shape of the strap of each electrode buried in the insulating substrate, and to improve the shape, material and thickness of the electrode for increasing the flexible strength of the electrode. However, it is difficult to achieve a sufficient reinforcement in the electron beam generating section in which a plurality of electrodes are arranged with a relatively small clearance provided therebetween.

As described above, the prior art is defective in that the wire welded to each of the first electrode and the second electrode of the electron gun assembly for the electrical connection to the circuit outside the cathode ray tube is thermally expanded so as to push the first electrode or a part of the second electrode, thereby changing the distance between these electrodes. What should be noted is that the cathode electrode current is changed by the thermal expansion of the wire so as to change the color of the displayed image.

Also, it is difficult to take sufficient measures against the problem because the distance between the first electrode and the second electrode is small.

BRIEF SUMMARY OF THE INVENTION

An object of the present invention is to provide a color cathode ray tube capable of suppressing the change in the cathode electrode current and, thus, capable of displaying a satisfactory image low in the color change, even if the conductive material connected to the electrode of the electron gun assembly for electrical connection to a circuit outside the tube is thermally expanded.

According to a first aspect of the present invention, there is provided a color cathode ray tube, comprising:

an envelope including a panel having a phosphor screen mounted therein, a funnel contiguous to the panel and including a neck;

an electron gun assembly including three cathode electrodes received in the neck at an edge portion of the funnel and heated by heaters sealed in the neck, electrodes having apertures corresponding to the three cathode electrodes and forming a section, together with the cathode electrodes, for generating electron beams, electrodes for forming a main lens section for focusing the electron beams on the phosphor screen, and an insulating supporting bar for supporting the electrodes;

a stem section having a portion welded to the neck section and stem pins buried in the circular portion for holding the electron gun assembly and for electrically connecting each of the electrodes to the circuit outside the tube; and a conductive member having one end connected to the stem pin and the other end connected at least one electrode included in the electron gun assembly, wherein the conductive member includes a folded buffering section for buffering the thermal expansion force accompanying the heat generation from the heater.

It should be noted that, in the color cathode ray tube of the present invention, a folded buffering section for buffering the thermal expansion force accompanying the heat generation from the heater is arranged in the conductive member connected to the electrode, for electrical connection to the circuit outside the tube. The folded buffering section is formed between that portion of the conductive member which is connected to the electrode and that portion of the conductive member which is connected to the stem pin. It follows that, even if the heat generated from the heater buried in the cathode electrode thermally expands the conductive member, the thermal expansion force of the conductive member is buffered by the folded buffering section so as to weaken the force in the direction of pushing the electrode. As a result, a change in the distance between adjacent electrodes, which is caused by the thermal expansion of the conductive member, can be eliminated so as to suppress the fluctuation in the cathode current. It follows that it is possible to provide a color cathode ray tube capable of displaying a satisfactory image free from the color change.

The present invention also provides a color cathode ray tube in which the conductive member is connected at one end to the stem pin and also connected at the other end to the electrode positioned closest to the cathode electrode included in the electron gun assembly. In the color cathode ray tube of the particular construction, the force in the direction of pushing the electrode positioned closest to the cathode electrode is weakened so as to eliminate the change in the distance between the adjacent electrodes, which is caused by the thermal expansion of the conductive member, thereby suppressing the change in the fluctuation of the cathode current. It follows that the color cathode ray tube of the present invention is enabled to display a satisfactory image free from the color change.

Further, the present invention provides a color cathode ray tube, in which the conductive member is connected at one end to the stem pin and also connected at the other end to each of the first electrode positioned closest to the cathode electrode and the second electrode positioned adjacent to the first electrode. In the color cathode ray tube of the particular construction, the force in the direction of pushing the first electrode positioned closest to the cathode electrode and the second electrode positioned adjacent to the first electrode is weakened so as to eliminate the change in the distance between the first and second electrodes, which is caused by the thermal expansion of the conductive member. As a result, it is possible to suppress the fluctuation of the cathode current so as to enable the color cathode ray tube to display a satisfactory image free from the color change.

Further, the present invention provides a color cathode ray tube, in which the folded buffering section of the conductive member is folded away from the inner wall of the tube in the neck. In the color cathode ray tube of the particular construction, the inner wall, which is an insulator, of the neck is charged up by the positive charge of the anode high voltage, making it possible to prevent the spark generation and the glow discharge taking place between the inner wall of the neck and the conductive member because of the approach of the conductive member toward the inner wall of the neck. It is also possible to prevent the short circuit with another conductive member.

Further, the present invention provides a color cathode ray tube, in which the folded buffering section of the conductive member is in the shape of a crank having at least one folded portion folded at an angle falling within a range of between 45° and 135° relative to the axial direction of the tube in the neck. In the color cathode ray tube of the particular construction, the thermal expansion force of the conductive member is resolved in the folded portion of the folded buffering section into the force in the axial direction of the tube and the force perpendicular to the axial direction of the tube. What should also be noted is that, since the folding angle falls within a range of between 45° and 135°, the force in the axial direction of the tube is smaller than the force in a direction perpendicular to the axial direction of the tube. In other words, the force in the pushing direction of the electrode included in the electron gun assembly, i.e., the force in the axial direction of the tube, is weakened so as to eliminate the change in the distance between the adjacent electrodes caused by the thermal expansion of the conductive member. It follows that it is possible to suppress the fluctuation of the cathode current so as to enable the color cathode ray tube to display a satisfactory image free from the color change.

It is undesirable for the folding angle of the folded buffering section to be smaller than 45° or to be larger than 135° because the force component in the axial direction of the tube is rendered large in this case so as to prevent the folded buffering section from performing its proper function.

Further, the present invention provides a color cathode ray tube, in which the folded buffering section of the conductive member is formed in the shape of a continuous wavy curve having a folding angle falling within a range of between 45° and 135° relative to the axial direction of the neck.

Further, the present invention provides a color cathode ray tube, in which the folded buffering section of the conductive member is formed in the shape of saw teeth having a folding angle falling within a range of between 45° and 135° relative to the axial direction of the neck.

Still further, the present invention provides a color cathode ray tube, in which the folded buffering section of the conductive member is formed in the shape of a semi-circular curve having a folding angle falling within a range of between 45° and 135° relative to the axial direction of the neck.

In the color cathode ray tube of the particular construction, the conductive member including the folded buffering section in the shape of a continuous wavy curve, in the shape of saw teeth, or in the shape of a semi-circular curve permits weakening the thermal expansion force of the conductive member in the axial direction of the tube. To be more specific, the force component of the thermal expansion force for pushing the electrode included in the electron gun assembly, i.e., the force component in the axial direction of the tube, is weakened, compared with the force component in a direction perpendicular to the axial direction of the tube. As a result, it is possible to suppress the change in the distance between the adjacent electrodes caused by the thermal expansion of the conductive member. It follows that it is possible to suppress the fluctuation of the cathode current so as to enable the color cathode ray tube to display a satisfactory image free from the color change.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 7 is a plan view schematically showing in a magnified fashion stem pins, a wire having a folded portion during deformation by thermal expansion, and a first electrode, which are used in the electron gun assembly included in the color cathode ray tube shown in FIG. 1;

FIGS. 8A to 8C are drawings each showing the relationship between the folding angle and the thermal expansion force in respect of the folded portion of the wire used in the electron gun assembly included in the color cathode ray tube shown in FIG. 1;

DETAILED DESCRIPTION OF THE INVENTION

A color cathode ray tube according to one embodiment of the present invention will now be described with reference to the accompanying drawings.

Figure 1:
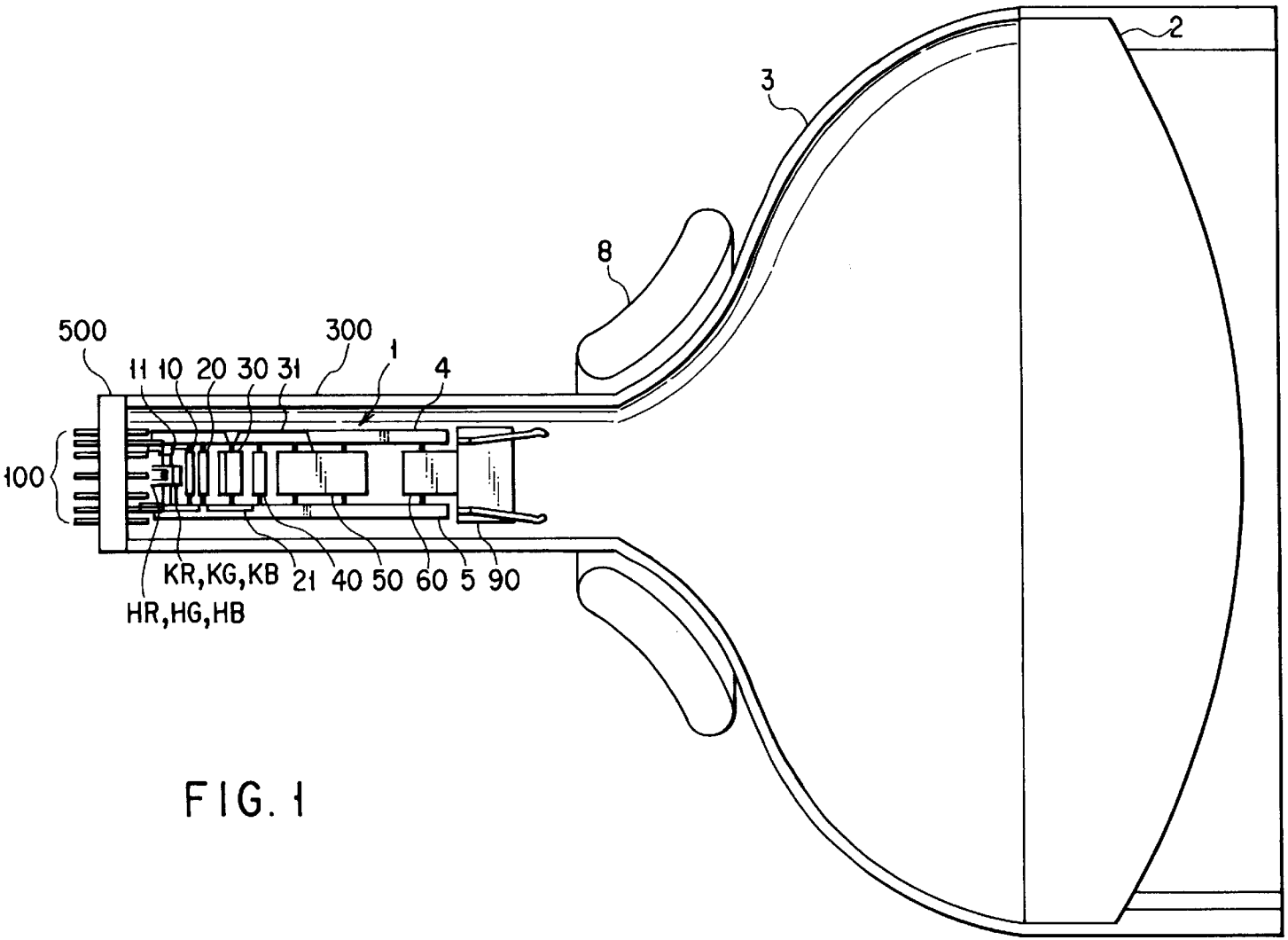
FIG. 1 is a cross sectional view schematically showing the construction of a color cathode ray tube according to one embodiment of the present invention.

FIG. 1 shows a color cathode ray tube according to one embodiment of the present invention. As shown in the drawing, the color cathode ray tube comprises an envelope including a panel 2 having a phosphor screen formed therein and a funnel 3 bonded integral to the panel 2 and having a neck 300 formed therein. An electron gun assembly 1 is arranged in the neck 300 of the funnel 3, and a deflection yoke 8 generating a magnetic field for deflecting the electron beam emitted from the electron gun assembly 1 toward the peripheral portion of the phosphor screen is mounted to the outer circumferential surface of the funnel 3.

Figure 2:
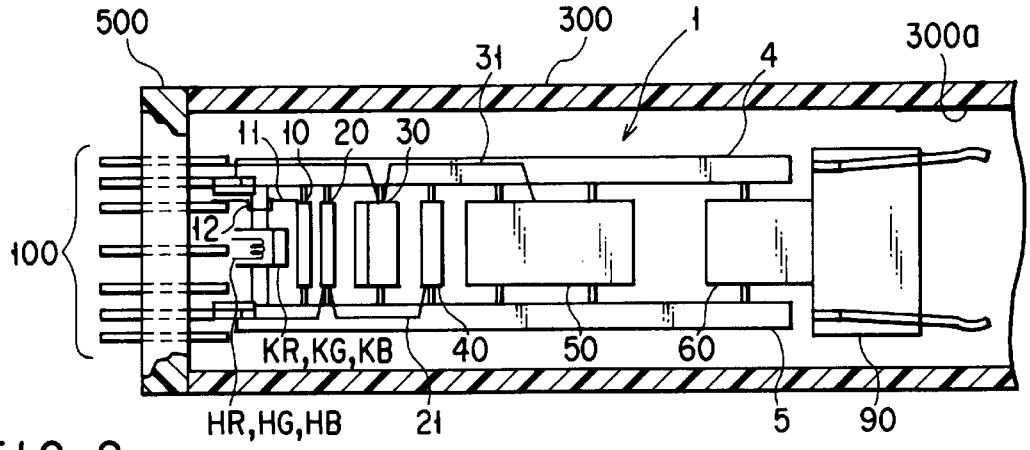
FIG. 2 is a cross sectional view schematically showing in a magnified fashion the electron gun assembly housed in the neck of the color cathode ray tube shown in FIG. 1.

As shown in FIGS. 1 and 2, the electron gun assembly 1 received in the neck 300 includes cathodes KR, KG, KB arranged in-line and having heaters HR, HG, HB housed therein, a first electrode 10, a second electrode 20, a third electrode 30, a fourth electrode 40, a fifth electrode 50, which is a focus electrode, a sixth electrode 60, which is a final accelerating electrode, and a shield cup 90, which are arranged in the order mentioned as viewed from the left in the drawing.

The electrodes other than the shield cup 90 are fixed to two insulating supporting bars 4, 5. Incidentally, the shield cup 90 is welded to the sixth electrode 60.

The cathodes KR, KG, KB are arranged in-line at an interval of about 5 mm, and each of the first electrode 10 to the sixth electrode 60 is provided with three apertures through which run three electron beams. Each of the first and second electrodes 10, 20 is provided with small apertures each having a diameter of about 1 mm or less. On the other hand, that region of the third electrode 30 which faces the second electrode 20 is provided with apertures each having a diameter of about 2 mm, which is larger than the aperture made in the second electrode 20. Further, each of that region of the third electrode 30 which faces the fourth electrode 40 and the fourth electrode 40 to the sixth electrode 60 is provided with relatively large apertures each having a diameter of about 4 to 6 mm.

A circular portion made of glass is welded to a stem section 500 of the neck 300 such that the electron gun assembly 1 is held by stem pins 100 which are made of a metal, are buried in and fixed to the circular portion made of glass. Each of the electrodes of the electron gun assembly 1 is electrically connected to the circuit outside the tube via the stem pin 100.

The electrodes included in the electron gun assembly 1 are arranged such that the apertures of the adjacent electrodes are allowed to face each other with a predetermined clearance provided therebetween. Applying a predetermined potential difference between these electrodes forms an electron lens. The electron beams passing through the apertures of each of the electrodes are focused on the phosphor screen so as to form beam spots on the phosphor screen.

The first electrode 10 and the second electrode 20 are positioned to face each other with a very small clearance of 0.5 mm or less provided therebetween. On the other hand, the second electrode 20, the third electrode 30, the fourth electrode 40, the fifth electrode 50 and the sixth electrode 60, which are arranged in the order mentioned, are positioned such that the adjacent electrodes are allowed to face each other with a clearance of about 0.5 to 1 mm provided therebetween.

The rear end portion of the electron gun assembly 1 received in the neck 300 is supported by the required number of stem pins 100 arranged in the circular glass portion formed in the stem section 500, and predetermined voltages are applied from outside the tube to the electrodes other than the sixth electrode 60 via the stem pins 100.

A voltage prepared by superposing a video signal on a DC voltage of 120 V is applied to each of the cathodes KR, KG and KB. The first electrode 10 is connected to the ground. The second electrode 20 is connected to the fourth electrode 40 within the tube, and a DC voltage of about 700 V is applied to the second electrode 20. The third electrode 30 is connected to the fifth electrode 50, which is a main focus electrode, within the tube, and a DC voltage of about 6 to 9 kV is applied to the third electrode 30. Further, a high anode voltage of about 25 kV is applied to each of the sixth electrode 60 and the shield cup 90 via an inner conductive film 300*a* coated on the inner wall of the neck 300.

The cathodes KR, KG and KB are heated by the heaters HR, HG and HB which are arranged within these cathodes for allowing these cathodes to emit electrons. When the electric field generated from the DC voltage of about 700 V applied to the second electrode 20 extends to reach the cathodes KR, KG and KB and exceeds the cathode voltage of about 120 V, electrons are emitted from the cathodes KR, KG and KB.

It should be noted that the electric field generated from the second electrode 20 is controlled by the first electrode 10 such that the electron beam passes through substantially the centers of the predetermined apertures of the first electrode 10 to the sixth electrode 60. In other words, the generated electron beam passes through substantially the center of the electron lens formed by the second electrode 20 to the sixth electrode 60.

It follows that the cathodes KR, KG, KB, the first electrode 10 and the second electrode 20 perform the function of forming an electron beam forwarded into the electron lens including the main lens, and region in which the cathodes KR, KG, KB, the first electrode 10 and the second electrode 20 are formed corresponds to the region performing the function of forming an electron beam.

The electron beams emitted from the cathodes KR, KG, KB are crossed over in the vicinity of the region ranging between the second electrode 20 and the third electrode 30, and the electron beam from the cross-over is dispersed. The electron beam is pre-focused by a pre-focus lens formed by the second electrode 20 and the third electrode 30, is further pre-focused by an auxiliary lens formed by the third electrode 30, the fourth electrode 40, and the fifth electrode 50, and is finally focused by the main lens formed by the fifth electrode 50 and the sixth electrode 60 so as to form a beam spot on the phosphor screen.

As shown in a magnified fashion in FIG. 2, one end of a conductive metal wire 11 is welded to the cathodes KR, KG, KB, the heaters HR, HG, HB, the first electrode 10 and the second electrode 20. Also, one end of a conductive metal wire 21 is welded to the fourth electrode 40. Further, one end of a conductive metal wire 31 is welded to the third electrode 30 and the fifth electrode 50. On the other hand, the other end portions of these conductive metal wires 11, 21, 31 are arranged not to contact the electrodes and the other wires in the neck 300, and the other ends of the conductive metal wires are welded to the stem pins 100.

Figure 3:
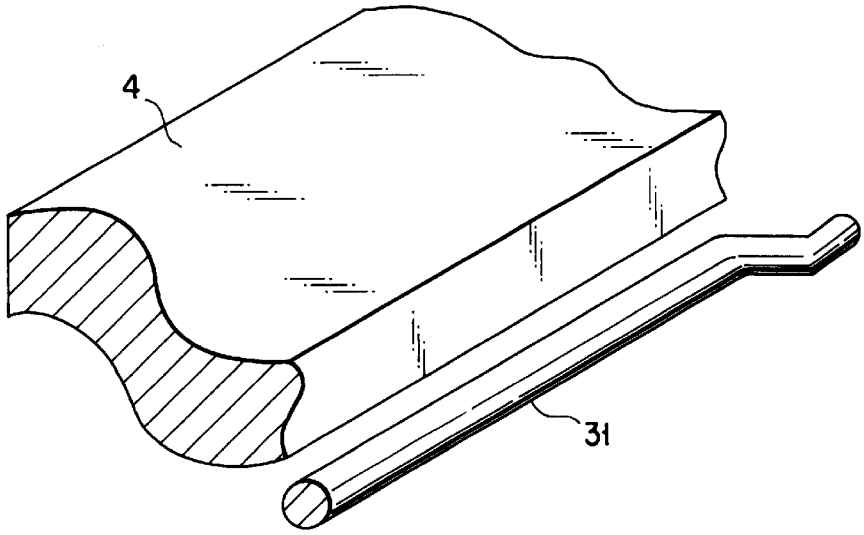
FIG. 3 is an oblique view, partly broken away, schematically showing in a magnified fashion an example of a wire used in the electron gun assembly included in the color cathode ray tube shown in FIG. 1.

The wire 31 is intended to apply a voltage close to the anode high voltage applied to the sixth electrode 60, which is a final accelerating electrode, to the fifth electrode 50 producing an electric field of a relatively high intensity in the neck 300 and to the third electrode connected to the fifth electrode 50. The electric field is likely to be concentrated in the edge portion of the wire 31 so as to deteriorate the withstanding voltage. Also, the distance from the fifth electrode 50 and the third electrode 30 to the stem pin 100 is longer than the distance between the other electrodes and the stem pin 100. Such being the situation, in order to prevent the wire 31 from being brought into contact with the other electrodes, a conductive lead wire having a circular cross section and a relatively large diameter is used as the wire 31 as shown in FIG. 3.

Figure 4:
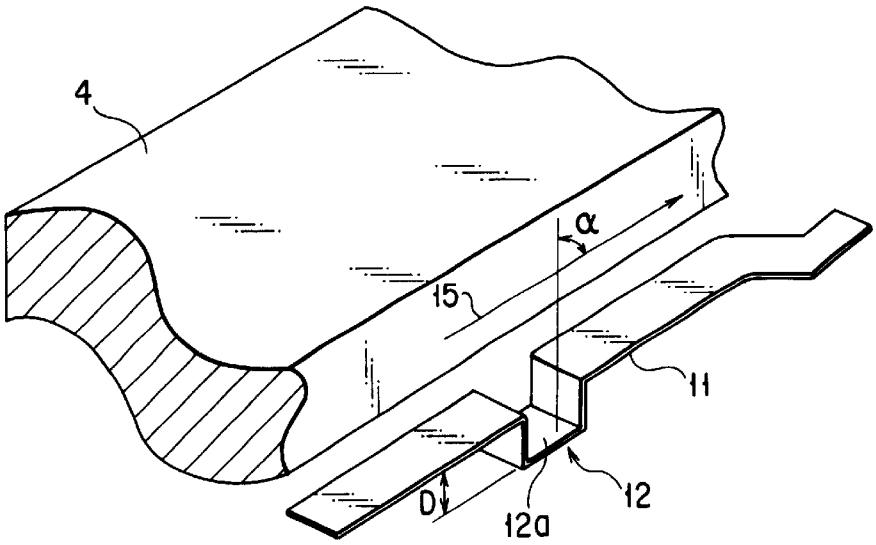
FIG. 4 is an oblique view, partly broken away, schematically showing in a magnified fashion a wire having a folded portion, which is used in the electron gun assembly included in the color cathode ray tube shown in FIG. 1.

On the other hand, a conductive lead wire formed in the shape of a thin ribbon-like strip as shown in FIG. 4 is used as the wire 11 other than the wire 31.

Figure 5:
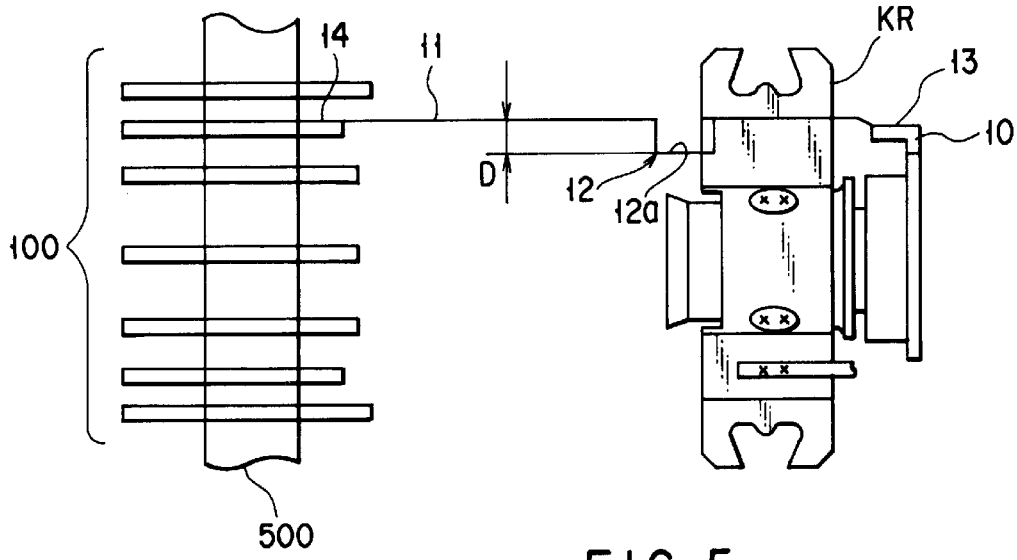
FIG. 5 is a plan view schematically showing in a magnified fashion stem pins, a wire having a folded portion, and a first electrode of the electron gun assembly included in the color cathode ray tube shown in FIG. 1.

The wire 11 welded to the first electrode 10 is in the shape of a thin ribbon having a thickness of, for example, 0.08 mm. As shown in FIGS. 4 and 5, a folded portion 12 acting as a crank-shaped folded buffering region for buffering the thermal expansion force is formed in the wire 11 between the welded portion 13 on the side of the first electrode 10 and the welded portion 14 to the stem spin 100. The folded portion 12 is folded such that the projecting side 12*a* is positioned away from the inner wall of the tube in the neck 300.

The folding angle of the folded portion 12 of the wire 11, i.e., the angle α relative to the tube axis 15 is set at, for example, 90°, and the step D of the wire 11 produced by the folding is set at, for example, about 1 mm.

Figure 6:
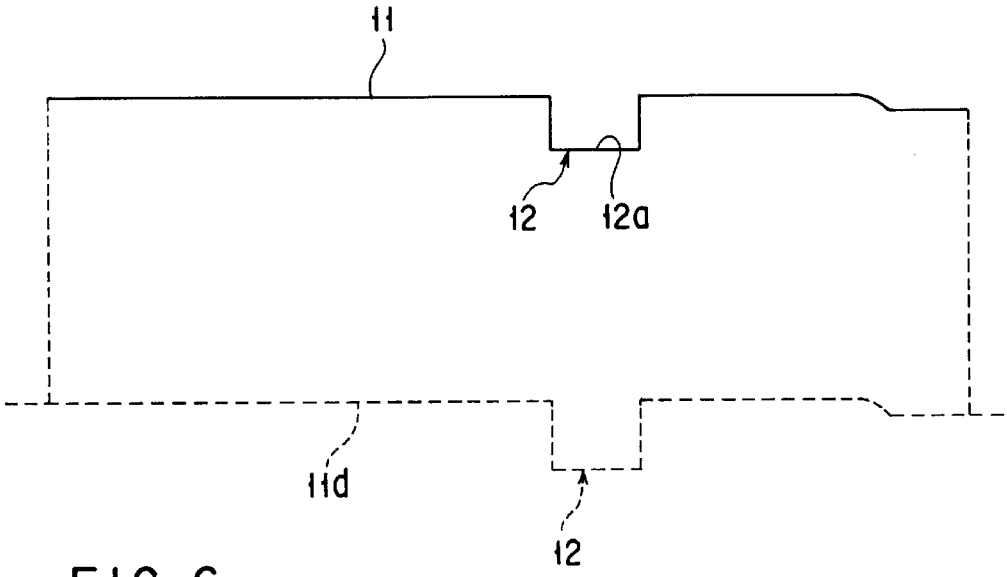
FIG. 6 shows the state of thermal expansion of a wire having a folded portion, which is used in the electron gun assembly included in the color cathode ray tube shown in FIG. 1.

If the cathodes KR, KG and KB are heated by the heaters HR, HG and HB, respectively, in the color cathode ray tube of the construction described above, the heat is conducted through the two insulating supporting bars 4 and 5. Also, the heat generated from each of the cathodes KR, KG and KB is radiated directly. It follows that, if the both ends of the wire 11 are free, the wire 11 itself is thermally expanded to have a shape 11*d* as denoted by a dotted line in FIG. 6. However, since one end of the wire 11 is fixed to the welded point 13 of the first electrode 10 and the other end is fixed to the welded point 14 on the side of the stem pin 100, the wire 11 is deformed as denoted by a broken like in FIG. 7. In other words, the elongation caused by the thermal expansion force acting on the wire 11 is absorbed by the deformation of the folded portion 12, and the expansion force of the wire 11 itself is weakened by the deformation of the folded portion 12. It follows that it is possible to avoid the difficulty that the wire 11 pushes the first electrode 10 so as to change the distance between the first electrode 10 and the second electrode 20. As a result, it is possible to eliminate the change in the distance between the adjacent electrodes, which is caused by the thermal expansion of the wire 11, so as to suppress the change in the fluctuation of the cathode current and, thus, to enable the color cathode ray tube to display a satisfactory image free from the color change.

It should also be noted that, since the wire 11 is folded such that the projecting side 12*a* of the folded portion 12 projects toward the side opposite to the inner wall of the tube in the neck 300, it is possible to prevent the projecting side 12*a* from being brought into contact with the other wire such as the wire 31 during thermal expansion of the wire 11. In other words, the short-circuiting can be prevented during the thermal expansion of the wire 11.

The folded portion 12 acting as a folded buffering region of the wire 11 will now be described more in detail with reference to FIG. 8.

It is desirable for the folding angle α, i.e., the bending angle relative to the tube axis direction, of the folded portion 12 to fall within a range of between 45° and 135°. To be more specific, where the folding angle α of the folded portion 12 of the wire 11 is 30°, which is smaller than 45°, as shown in FIG. 8A, the thermal expansion force f of the wire 11 is resolved into the force component f1 in the axial direction of the tube and the force component f2 perpendicular to the force component f1. These force components f1 and f2 meet the relationship f1>f2. Also, where the folding angle α in the folded portion 12 of the wire 11 is 45° as shown in FIG. 8B, the force components f1 and f2 meet the relationship f1=f2. Further, where the folding angle α in the folded portion 12 of the wire 11 is, for example, 60°, which is larger than 45°, as shown in FIG. 8C, the force component f1 and the force component f2 meet the relationship f1<f2. In other words, where the folding angle α falls within a range of between 45° and 135°, the force component in the axial direction of the tube is made smaller than the force component perpendicular to the force component in the axial direction of the tube, with the result that the force component f1 for pushing the first electrode 10 is made smaller than the force component f2 perpendicular to the force component f1. On the other hand, if the folding angle α is smaller than 45°, the force component f1 in the axial direction of the tube is increased. Naturally, it is undesirable to employ such a folding angle α. The force component f1 in the axial direction of the tube is also made larger than the force component f2 perpendicular to the force component f1 in the case where the folding angle α is larger than 135°. Naturally, it is undesirable for the folding angle α to be larger than 135°.

Figure 9:
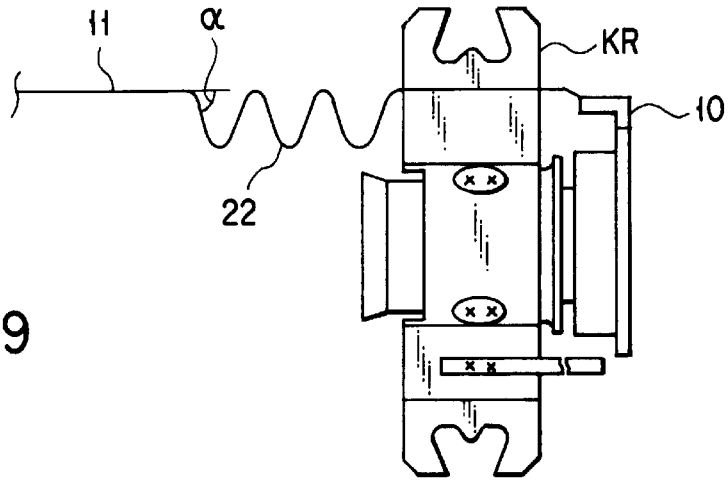
FIG. 9 is a plan view schematically showing a wire having a wavy folded portion and a first electrode used in the electron gun assembly included in the color cathode ray tube shown in FIG. 1.

FIG. 9 shows a modification of the folded portion 12 of the wire 11. In the modification shown in FIG. 9, a folded portion 22 of the wire 11 is formed in the shape of a continuous wavy curve having a substantial folding angle α falling within a range of between 45° and 135°.

Figure 10:
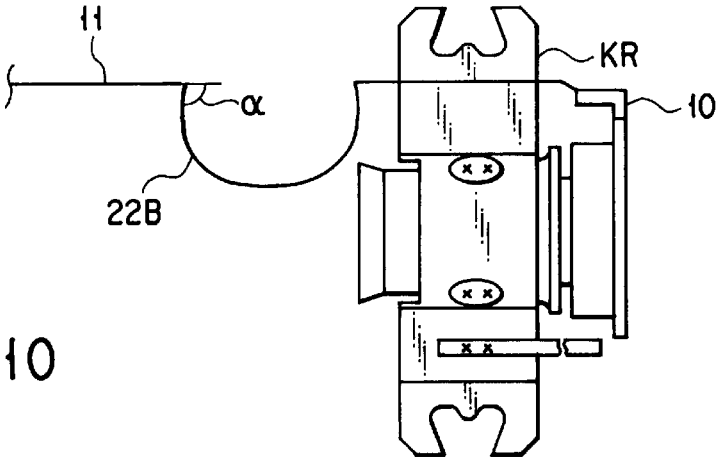
FIG. 10 is a plan view schematically showing a wire having a folded portion of a semi-circular shape and used in the electron gun assembly included in the color cathode ray tube shown in FIG. 1.

FIG. 10 shows another modification of the folded portion 12 of the wire 11. In the modification shown in FIG. 10, a folded portion 22A of the wire 11 is formed in the shape of a semi-circular curve having a substantial folding angle α falling within a range of between 45° and 135°.

Figure 11:
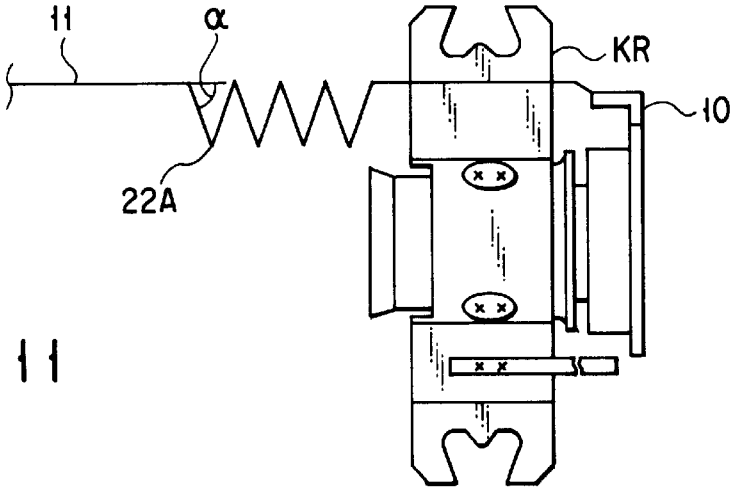
FIG. 11 is a plan view schematically showing a wire having a folded portion in the shape of saw teeth and used in the electron gun assembly included in the color cathode ray tube shown in FIG. 1.

Further, FIG. 11 shows still another modification of the folded portion 12 of the wire 11. In the modification shown in FIG. 11, a folded portion 22B of the wire 11 is formed in the shape of saw teeth having a substantial folding angle α falling within a range of between 45° and 135°.

Each of the wires 11 having the folded portion 22, the folded portion 22A and the folded portion 22B shown in FIGS. 9, 10 and 11, respectively, also produce the effect similar to that described previously.

The first embodiment described above is directed to the wire 11 welded to the first electrode 10. However, the present invention is not limited to the first embodiment. For example, the technical idea of the present invention can also be applied to the wire welded to the second electrode 20, with substantially the same effect.

Further, in the embodiment described above, the folded portion 12 of the wire 11 is formed in only one portion. However, it is also possible in the present invention to form a plurality of folded portions in the wire 11.

Further, in the embodiment described above, the wire 11 has a thickness of 0.08 mm and a folding depth of 1.0 mm. However, the thickness and the folding depth of the wire are not particularly limited in the present invention. In other words, a desired effect can be obtained in the present invention regardless of the thickness and the folding depth of the wire, as far as the folding angle falls within a range of between 45° and 135°.

Still further, in the embodiment described above, the folded portion of the wire has a crank shape, a wavy shape or a semi-circular shape. However, the shape of the folded portion of the wire is not particularly limited in the present invention, as far as the folded portion is capable of absorbing the elongation of the wire caused by the thermal expansion in a manner to suppress the displacement of the electrode to which the wire is welded.

As described above, the present invention provides a color cathode ray tube provided with a folded buffering section which prevents the distance between the adjacent electrodes, particularly, the distance between the first electrode and the second electrode, from being changed even if the conductive member for supplying a voltage from outside the tube to the electrodes of the electron gun assembly is heated by the heater arranged within the cathode so as to be thermally expanded. It follows that it is possible to suppress the fluctuation of the cathode current caused by the heating so as to enable the color cathode ray tube to display a satisfactory image free from the color change.

The present invention also provides a color cathode ray tube capable of preventing a short circuit with another member such as a conductive member even if the conductive member is thermally expanded.

Further, the present invention provides a color cathode ray tube, in which the force for pushing the electrode included in the electron gun assembly is weakened during thermal expansion of the conductive member by setting appropriately the folding angle of the folded buffering section so as to eliminate the change in the distance between the adjacent electrodes and, thus, to suppress the change in the fluctuation of the cathode current, thereby enabling the color cathode ray tube to display a satisfactory image free from the color change.

Still further, the present invention provides a color cathode ray tube using a conductive member provided with a folded buffering section having a shape of a continuous wavy curve, a shape of saw teeth, or a shape of a semi-circular curve so as to suppress the fluctuation of the cathode current, thereby enabling the color cathode ray tube to display a satisfactory image free from the color change.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode ray tube, comprising:

an envelope including a panel having a phosphor screen mounted therein, a funnel contiguous to the panel and including a neck;

an electron gun assembly including three cathode electrodes received in the neck at an edge portion of the funnel and heated by heaters sealed in the neck, a first plurality of electrodes having apertures corresponding to the three cathode electrodes and forming a section, together with the three cathode electrodes, for generating electron beams, a second plurality of electrodes for forming a main lens section for focusing the electron beams on the phosphor screen, and an insulating supporting bar for supporting the three cathode electrodes and the first and second plurality of electrodes;

a stem section having a portion welded to the neck section and stem pins buried in the circular portion for holding the electron gun assembly and for electrically connecting each of the three cathode electrodes and the first and second plurality of electrodes to the circuit outside the tube; and a conductive member having one end connected to a respective stem pin and the other end connected to at least one electrode included in the electron gun assembly, wherein the conductive member includes a folded buffering section for buffering the thermal expansion force accompanying the heat generation from the heater.

2. The color cathode ray tube according to claim 1, wherein said conductive member is connected at one end to said respective stem pin and also connected at the other end to an electrode positioned closest to the three cathode electrodes.

3. The color cathode ray tube according to claim 1, wherein said conductive member includes a plurality of conductive members respectively connected at one end to a corresponding stem pin and also connected at the other end to each corresponding electrode positioned closest to the three cathode electrodes and an electrode positioned adjacent to the electrode positioned closest to the three cathode electrodes.

4. The color cathode ray tube according to claim 1, wherein said folded buffering section of the conductive member is folded away from the inner wall of the tube in the neck.

5. The color cathode ray tube according to claim 1, wherein said folded buffering section of the conductive member is in the shape of a crank having at least one folded portion having a folding angle falling within a range of between 45° and 135° relative to the axial direction of the tube in the neck.

6. The color cathode ray tube according to claim 1, wherein said folded buffering section of the conductive member is formed in the shape of a continuous wavy curve having a folding angle falling within a range of between 45° and 135° relative to the axial direction in the neck.

7. The color cathode ray tube according to claim 1, wherein said folded buffering section of the conductive member is formed in the shape of saw teeth having a folding angle falling within a range of between 45° and 135° relative to the axial direction in the neck.

8. The color cathode ray tube according to claim 1, wherein said folded buffering section of the conductive member is formed in the shape of a semi-circular curve having a folding angle falling within a range of between 45° and 135° relative to the axial direction in the neck.

* * * * *